US005269166A

United States Patent [19]

Thomas

[11] Patent Number: 5,269,166

[45] Date of Patent: Dec. 14, 1993

[54] HOT STRIP MILL WITH COILING FURNACE HAVING SEPARABLE HOUSING

[75] Inventor: John E. Thomas, Pittsburgh, Pa.

[73] Assignee: Tippins Incorporated, Pittsburgh, Pa.

[21] Appl. No.: 828,008

[22] Filed: Jan. 30, 1992

[51] Int. Cl.[5] ..... B21C 47/04

[52] U.S. Cl. ..... 72/148; 72/202

[58] Field of Search ..... 72/202, 200, 148, 146, 72/128; 242/78.1, 78.8

[56] References Cited

U.S. PATENT DOCUMENTS

| | | | |
|---|---|---|---|
| 1,918,968 | 7/1933 | Keeney et al. | 72/148 |
| 2,628,790 | 2/1953 | Schmidt et al. | 242/78 |
| 2,646,231 | 7/1953 | Frielinghaus | 242/78 |
| 2,658,741 | 11/1953 | Schmidt et al. | 263/3 |
| 2,675,720 | 4/1954 | Ferm | 80/32 |
| 3,613,426 | 10/1971 | J. R. Adair et al. | 72/202 |
| 4,263,798 | 4/1981 | Wladika et al. | 72/202 |
| 4,319,474 | 3/1982 | Gronbech | 72/229 |
| 4,430,874 | 2/1984 | Tippins et al. | 72/202 |
| 4,442,690 | 4/1984 | Hirschmanner et al. | 72/128 |
| 4,455,848 | 6/1984 | Tippins et al. | 72/12 |
| 4,485,651 | 12/1984 | Tippins et al. | 72/12 |
| 4,703,640 | 11/1987 | Buchegger et al. | 72/128 |
| 4,761,983 | 8/1988 | Ginzburg et al. | 72/148 |
| 4,869,089 | 9/1989 | Kuramoto | 72/13 |
| 5,009,092 | 4/1991 | Buchegger | 72/148 |
| 5,131,134 | 7/1992 | Quambusch et al. | 72/202 |

FOREIGN PATENT DOCUMENTS

| | | | |
|---|---|---|---|
| 4016256 | 12/1990 | Fed. Rep. of Germany . | |
| 59-191502 | 10/1984 | Japan . | |
| 0191502 | 10/1984 | Japan | 72/202 |
| 0119328 | 6/1986 | Japan | 242/78.1 |
| 1122605 | 5/1989 | Japan . | |
| 593759 | 2/1978 | U.S.S.R. . | |
| 420355 | 12/1934 | United Kingdom . | |
| 2232368 | 12/1990 | United Kingdom . | |

*Primary Examiner*—Lowell A. Larson
*Assistant Examiner*—Michael S. McKeon
*Attorney, Agent, or Firm*—Webb, Burden, Ziesenheim & Webb

[57] ABSTRACT

A hot strip mill including an improved coiler furnace adapted to minimize heat losses and exposure of the roller table to extreme working conditions. The coiler furnace includes a mandrel which is mounted within a housing. An access opening is provided in the housing for allow for entry and exit of the stripper material being worked upon. A pivotable diverter is mounted on a pivot pin adjacent this opening and is shiftable between a closed position which substantially seals the housing closing of the access opening and an open position which extends into the pass line of the roller table of the hot strip mill to divert the strip being worked upon into the coiler furnace.

16 Claims, 1 Drawing Sheet

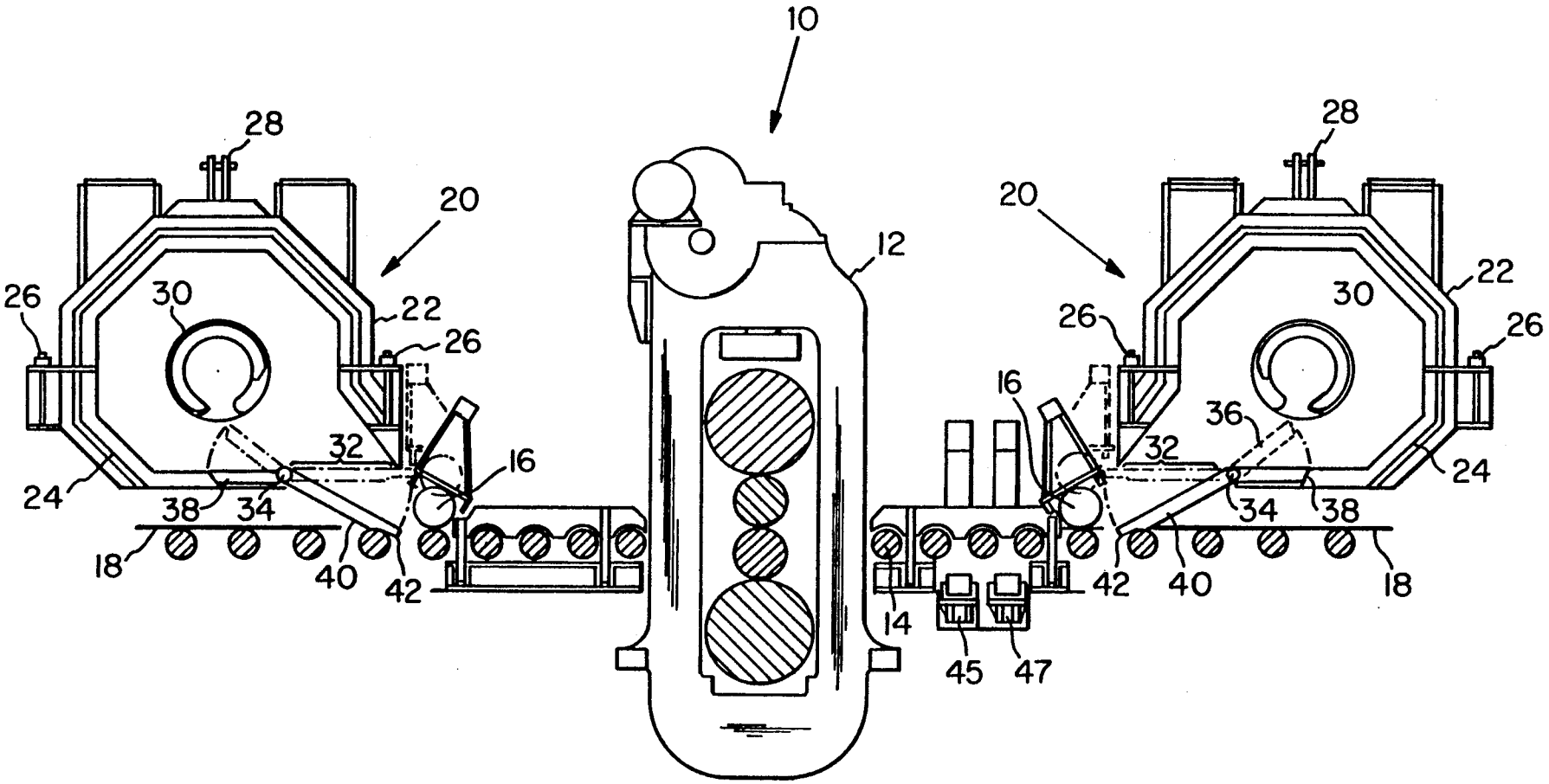
10
12
14
16
18
20
22
24
26
28
30
32
34
36
38
40
42
45
47

HOT STRIP MILL WITH COILING FURNACE HAVING SEPARABLE HOUSING

FIELD OF THE INVENTION

This invention relates to an improved hot strip mill, specifically towards an improved coiler furnace arrangement for a hot strip mill.

BACKGROUND OF THE INVENTION

Coiler furnaces have long been utilized with reversing hot strip mills. In general, the coiler is provided with a housing in which a rotatable mandrel is mounted. The strip being worked upon is wound onto the mandrel after being passed through the mill rollers and along the roller table. U.S. Pat. Nos. 4,761,983, 4,485,651, 4,442,690, 2,675,720 and 2,646,231 disclose these types of coiler furnaces. The strip of material being worked is fed onto a rotatable mandrel in the coiler through an opening in the bottom of the coiler housing. These known mills include diverters built into the roller tables to guide the strip onto the coiler mandrel. The diverters are adapted to be pivoted out of the roller table and into an opening provided in the housing. The openings are generally large. Consequently, much of the heat in the coiler furnaces is lost through the opening.

The rolls on the roller table beneath the opening are subjected to excessive amounts of heat which escapes from the interior of the coiler furnace. This exposure to extreme conditions reduces the working life of the exposed rolls and the entire roller table.

Soviet Reference No. 593,759 provides a reversing mill having closable shutters associated with each coiler furnace such that any required atmosphere may be easily maintained within a specific coiler furnace. The mill disclosed in the Soviet reference does not provide deflectors for easily guiding the strip into the coilers. The reversible mill of the Soviet reference operates without a conventional roller table and receives the strip directly from a guide roll adjacent the rollers. The mill disclosed in the Soviet reference does not provide for the easy transport or handling of the material to be worked upon.

The present invention avoids these disadvantages and difficulties by providing a hot strip mill with a coiler furnace which minimizes the energy losses from the coiler furnace, provides needed guidance of the strip, does not require a deflector to be incorporated into the roller table, and shields the roller table from excessive working conditions.

SUMMARY OF THE INVENTION

In accordance with the invention, the objects of the present invention are achieved by providing a roller mill, with a roller table positioned on opposite sides of the roller mill and adapted to pass a strip of material to be worked upon to and from the roller mill. A pair of coiler furnaces are positioned on opposite sides of the roller mill adjacent to the roller table. Each of these coiler furnaces includes a mandrel, a housing surrounding the mandrel provided with an upper and lower portion and an access opening in the lower housing portion to allow for the entry and exit of the strip. A first pivotable diverter is provided in the coiler furnace housing and is pivotably mounted on a pivot pin positioned adjacent the lower housing portion. The first pivotable diverter is pivoted between a closed position which substantially seals the housing, closing off the access opening, and an open position in which the first diverter extends into the pass line of the roller table.

The coiler furnace of the present invention is adapted to be easily repaired and removed and does not require a specialized diverter to be incorporated into the roller table. The first pivotable diverter of the coiler furnace is adapted to seal off the housing when in a closed position and thereby minimize energy losses out of the coiler furnace and minimize the exposure of the roller table to extreme heat and working conditions. This dual effect will reduce the cost of operating the mill and increase the working life of the associated elements.

Preferably, the housing and the pivotable diverter are constructed of a heat insulating material to further reduce the heat losses from the coiler furnace.

The invention will be explained in more detail with reference to the accompanying drawings.

BRIEF DESCRIPTION OF THE DRAWINGS

FIGURE 1 is a vertical section through a hot strip of the present invention.

DESCRIPTION OF THE PREFERRED EMBODIMENTS

FIGURE 1 illustrates an elevational sectional view of mill 10. Mill 10 is comprised of a four-high roller mill 12, a roller table 14 positioned adjacent the roller mill 12 to cooperate therewith and pass the strip or slab being worked upon repeatedly through the roller mill 12, then onto a next station. The strip is moved on top of the roller table 14 on what is known as a pass line 18. Coiler furnaces 20 are positioned on either side of the roller mill 12. Pinch rollers 16 are provided to maintain the necessary movement of the strip being worked upon.

Coiler furnace 20 includes an upper housing 22 which is removably attached to a lower housing 24 through the positioning of locating pins 26. A single lift point 28 is provided on the coiler furnace 20 to allow for movement of the coiler furnace 20 or removal of the upper housing 22 providing for easy repair and placement of the coiler furnace 20 and its associated parts. Conventional heating units (not shown) may also be located within the upper and lower housing (22 and 24).

A mandrel 30 is positioned on the interior of the coiler furnace 20. An access opening 32 is provided in the lower housing 24 to allow for the strip to be fed into the mandrel 30. A pivot pin 34 is positioned adjacent the opening 32 at a location above the lower housing 24. An upper diverter 36 is pivotably attached to the pivot pin 34 and adapted to be received in a recess 38 formed in the lower housing 24. The upper diverter 36 is needed to direct the initial or front portion of the strip into the mandrel 30. After the mandrel 30 begins coiling the strip, the upper diverter 36 may be pivoted out of the way into the recess 38. The upper diverter 36 is adapted to be pivoted into the recess so that it is substantially flush with the inner surface of the lower housing 24, thereby not interfering with the coiling of the strip on the mandrel 30.

A lower diverter 40 is also attached to the pivot pin 34. The lower diverter 40 in its downward most or open position extends from the pivot pin 34 to the roller table 14 into the pass line 18 to direct the strip into the coiler furnace 20. The lower diverter 40 is provided with a recess 42 which cooperates with the rollers of the roller table 14 to allow the lower diverter 40 to better penetrate the pass line 18 and insure that the strip is properly deflected into the mandrel 30.

When the lower diverter 40 is positioned in its upward most position, the lower diverter 40 will extend from the pivot pin 34 across the access opening 32 to completely close off the access opening 32 and substantially seal the coiler furnace 20. The lower diverter 40 in the closed position maintains a substantially closed environment in the interior of the coiler furnace, thereby minimizing energy losses through the access opening 32. This shields the roller table 14 from being subjected to excessive amounts of heat.

Quality control devices, such as an x-ray gauge 45 and profile gauge 47, may be positioned along the roller table 14 to allow for systematic checking and quality control of the strip during operation.

In general, the mill 10 operates in the following fashion: A strip to be worked upon comes to the mill 10, such as from a slabbing mill or a slab furnace or the like, at the left and the first pass through the mill 10 is made from left to right. The lower diverter 40 under both the left and right coiler furnaces 20 will be pivoted up in the closed position to allow the strip to pass under both coiler furnaces 20 and to minimize energy loss from the coiler furnaces 20. The strip will be passed repeatedly through the four-high roller mill 12 until the strip is thin enough that it may be coiled. Assuming that the strip is on the right side of the mill 10 when it is first thin enough to be coiled, the next pass from right to left proceeds as follows, the lower deflector 40 of the left coiler furnace 20 will be lowered to the open position with the rolls of roll table 14 being received in deflector recess 42 to provide for the directing of the leading edge of the strip up into the left coiler furnace 20. The upper diverter 36 will be pivoted up to direct the leading edge of the strip into the mandrel 30. The coiler will be started just as the strip enters the mandrel 30 and accelerates rapidly to bring the strip under tension by the time that the mandrel 30 has made about one revolution. As soon as the mandrel 30 starts, the upper deflector 36 is lowered into recess 38 so as not to interfere with the growing coil. At the end of this pass the mill 10 may be stopped so that the tail end of the strip is between the four-high mill 12 and left pinch rollers 16. The four-high mill 12 is set for the next pass; i.e., the rolls are moved closer together, the lower deflector 40 of the right coiler furnace 20 is lowered and the left pinch rollers 16 are driven in the reverse direction to feed the strip back through the four-high mill 12 and into the right coiler furnace 20. Heating means are generally provided in the coiler furnace 20 to allow for continued heating of the strip such that the strip may be maintained at the desired working temperature. The closing of the lower deflector 40 maintains the heat within the coiler furnace 20. It is also possible that the working strip may be coiled entirely on a mandrel 30 within coiler furnace 20 and the lower deflector 40 be pivoted into the upper closed position to provide a substantially sealed environment within the coiler furnace 20 such that the entire roll of strip material to be worked may be heated to the desired working temperature with a minimization of energy losses.

While one particular embodiment of the invention has been described above for the purposes of illustration, it will be evident to those skilled in the art that variations of the details may be made without departing from the spirit of the invention, the scope of which is defined in the appended claims.

I claim:

1. A mill for working a strip of material comprising:

a roller mill;

a roller table defining a pass line positioned on opposite sides of said roller mill and adapted to pass a strip of material to be worked to and from said roller mill; and a pair of coiler furnaces positioned on opposite sides of said roller mill adjacent said roller table, each of said coiler furnaces comprise a mandrel, a housing surrounding said mandrel provided with upper and lower portions and an access opening in said lower housing portion to allow for the entry and exit of said strip, wherein said lower and upper housing portions are separable and coupled together with at least a pair of locating pins provided on opposed sides of said upper and lower housing portions, wherein each of said pair of locating pins extend through extensions provided on said lower housing portion and said upper housing portion, a first pivotable diverter pivotably mounted on a pivot pin which is positioned adjacent said lower housing portion, whereby said first pivotable diverter is pivotable between a closed position which substantially seals said housing closing off said access opening and an open position in which said first diverter extends into said pass line on said roller table, and a second diverter pivotably attached to said pivot pin, said second diverter pivotable between a first position extending towards said mandrel to guide the leading edges of said strip into proper engagement with said mandrel and a second position, wherein said lower housing portion includes a rigid lower member extending to a position adjacent said pivot pin which is below said second diverter, said rigid lower member including a recess formed therein which is adapted to receive said second diverter in said second position wherein said second diverter is substantially flush with an inner surface of said rigid lower member.

2. The mill of claim 1 wherein said second diverter operates independently of said first diverter.

3. The mill of claim 1 wherein said first diverter is provided with a recess which cooperates with said roller table when said diverter is in said open position.

4. The mill of claim 1 further comprising an x-ray gauge and a profile gauge positioned adjacent said roller mill.

5. The roller mill of claim 1 wherein said lower housing portion extends upwards substantially to the height of said mandrel and said upper housing portion extending downward substantially to the height of said mandrel.

6. The roller mill of claim 5 wherein said rigid lower member and said recess are substantially parallel to said pass line.

7. The roller mill of claim 6 wherein said first pivotable diverter in said closed position and said second diverter in said second position are substantially parallel to said pass line.

8. The roller mill of claim 7 wherein the interior of said upper and lower housing portions are substantially planar.

9. The roller mill of claim 8 wherein a single lift point is provided on said upper housing portion substantially midway between said locating pins.

10. The roller mill of claim 9 wherein an x-ray gauge is positioned between said roller mill and one of said coiler furnaces and a profile gauge is provided adjacent said x-ray gauge between said x-ray gauge and said coiler furnace.

11. A coiler furnace for coiling a strip of material such as in a roller mill, said coiler furnace comprising:

a mandrel;

a housing surrounding said mandrel provided with an upper and lower portion and an access opening in said lower housing portion to allow for entry and exit of said strip, wherein said lower and upper housing portions are separable and coupled together with at least a pair of locating pins provided on opposed sides of said upper and lower housing portions, wherein each of said pair of locating pins extend through extensions provided on said lower housing portion and said upper housing portion;

a first pivotable diverter pivotably mounted on a pivot pin which is positioned adjacent said lower housing portion, whereby said first pivotable diverter is pivotable between a closed position which substantially seals said housing closing off said access opening and an open position in which said first diverter extends to direct said strip into said coiler furnace; and a second diverter pivotably attached to said pivot pin, said second diverter pivotable between a first position extending towards said mandrel to guide the leading edges of said strip into proper engagement with said mandrel and a second position, wherein said housing lower portion includes a rigid lower member extending to a position adjacent said pivot pin which is below said second diverter, said rigid lower member including a recess formed therein which is adapted to receive said second diverter in said second position wherein said second diverter is substantially flush with an inner surface of said rigid lower member in said second position.

12. The coiler of claim 8 wherein said second diverter operates independently of said first diverter.

13. The coiler of claim 11 wherein said first diverter includes a recess formed on a bottom portion of said first diverter.

14. The coiler furnace of claim 11 wherein said lower housing portion extends upwardly substantially to the height of said mandrel and said upper housing portion extends downward substantially to the height of said mandrel.

15. The coiler furnace of claim 14 wherein the interior of said upper and lower housing portions are substantially planar.

16. The coiler furnace of claim 15 wherein a single lift point is provided on said upper housing portion substantially midway between said locating pins.

* * * * *